US005730367A

United States Patent [19]

Pace et al.

[11] Patent Number: 5,730,367

[45] Date of Patent: Mar. 24, 1998

[54] FUEL INJECTOR WITH AIR BUBBLE/FUEL DISPERSION PRIOR TO INJECTION AND METHODS OF OPERATION

[75] Inventors: Jeffrey B. Pace, Newport News; Vernon R. Warner, Wicomico, both of Va.

[73] Assignee: Siemens Automotive Corporation, Auburn Hills, Mich.

[21] Appl. No.: 686,939

[22] Filed: Jul. 26, 1996

[51] Int. Cl.[6] ..... F02M 51/00

[52] U.S. Cl. ..... 239/408; 239/585.4; 239/585.1

[58] Field of Search ..... 239/408, 398, 239/462, 585.1–585.5; 251/129.21

[56] References Cited

U.S. PATENT DOCUMENTS

| | | | |
|---|---|---|---|
| 4,088,104 | 5/1978 | Ibbott . | |
| 4,137,875 | 2/1979 | Medina . | |
| 4,359,035 | 11/1982 | Johnson . | |
| 4,519,370 | 5/1985 | Iwata . | |
| 4,628,890 | 12/1986 | Freeman . | |
| 4,846,402 | 7/1989 | Sandell et al. . | |
| 5,191,871 | 3/1993 | Liskow . | |
| 5,193,743 | 3/1993 | Romann et al. | 239/585.5 X |
| 5,224,458 | 7/1993 | Okada et al. . | |
| 5,269,283 | 12/1993 | Thompson . | |
| 5,323,753 | 6/1994 | Cikanek Jr. et al. . | |
| 5,323,966 | 6/1994 | Bucholz et al. | 239/585.5 X |
| 5,402,937 | 4/1995 | Bucholz et al. | 239/585.5 X |
| 5,441,032 | 8/1995 | Ikuta et al. . | |
| 5,518,182 | 5/1996 | Sasao . | |

*Primary Examiner*—Lesley D. Morris
*Attorney, Agent, or Firm*—Russel C. Wells

[57] ABSTRACT

A fuel injector for an engine includes a fuel volume having an air inlet port having a porous membrane. The membrane is permeable to air and impermeable to fuel whereby air inlet to the fuel volume forms a two-phase air bubble/fuel dispersion within the fuel volume. Upon actuation of the needle valve of the injector, this two-phase air bubble/fuel dispersion flows through the orifice into the engine whereby improved atomization, burn and fuel economy with resultant reduction in emissions are provided.

15 Claims, 2 Drawing Sheets

FUEL INJECTOR WITH AIR BUBBLE/FUEL DISPERSION PRIOR TO INJECTION AND METHODS OF OPERATION

TECHNICAL FIELD

The present invention relates generally to fuel injectors, typically employed to inject fuel into an engine, and particularly relates to the formation of an air bubble/fuel dispersion in the fuel prior to spraying the fuel through the fuel injector orifice and to methods of operating the fuel injector.

BACKGROUND

Fuel injectors typically comprise an electromagnetically actuated needle valve disposed in a fuel volume and which needle valve is reciprocated axially within the fuel volume in response to energization and deenergization of an actuator to selectively open and close a flow path through the fuel injector. Particularly, the valve body or housing defining the fuel volume has an aperture or orifice at one end forming a seat for the end of the needle valve whereby its reciprocating motion enables an intermittent flow of fuel through the orifice. Typically, the fuel emitted from a fuel injector is atomized downstream of the orifice to provide the necessary fuel/air mixture in the combustion chamber of the engine.

DISCLOSURE OF THE INVENTION

In accordance with the present invention, improved atomization, fuel economy and burn with resulting lower emissions are achieved by providing a two-phase air bubble/fuel dispersion in the fuel volume of the fuel injector upstream of the injector orifice enabling a controlled atomized flow of air and fuel through the injector orifice. It will be appreciated that, for most engines, it is highly desirable to provide a known controllable mass of fuel to the engine and that fuel atomization occurs downstream of the injector orifice. Because air bubbles have a propensity to rise in fuel, any effort to atomize the fuel upstream of the injector orifice would render substantially indeterminate the mass flow of fuel through the injector orifice. In accordance with the present invention and recognizing that bubble rise time is proportional to bubble size, the bubble size is maintained sufficiently small so that bubbles do not rise or rise very slowly such that a controllable mass of the air bubble/fuel dispersion can be ejected through the orifice of the injector. Thus, the present invention provides a homogeneous dispersion of very small air bubbles in the fuel such that the fuel/air ratio and hence the mass of the fuel supplied through the injector orifice remains a known substantially constant value.

More particularly and according to the present invention, one or more porous members, i.e., a ceramic, metallic or foam plastic membrane, are provided, each having a pore size permeable to air and impermeable to fuel. Each porous member is preferably carried in an air inlet to the injector housing for flowing air directly into the fuel volume upstream of the injector orifice. By selecting a predetermined pore size, the size of the air bubbles formed in the fuel in the fuel volume by passing air through the member is controlled such that the bubbles do not substantially rise in the fuel or rise slowly whereby a substantially constant mass of two-phase air bubble/fuel dispersion is supplied to the engine through the orifice. It has been found that pore sizes of 40 microns or less provide an appropriately sized bubble of similar size in the fuel volume. The magnitude of the distribution of air bubbles in the fuel volume can be selected depending upon the difference in pressure across the porous membrane, the area of the porous membrane and/or the thickness of the membrane. Each of these parameters may be adjusted to provide the desired bubble size distribution and mass of bubbles in the fuel, enabling creation of a desirable two-phase flow from the fuel volume of the injector through the orifice into the engine. The above-noted beneficial results of the present invention are achieved preferably upon engine start-up.

In a preferred embodiment according to the present invention, there is provided a fuel injector for an engine comprising a housing defining a volume for receiving fuel and having an orifice, a valve movable between positions closing and opening the orifice, the housing including a port, a porous member in the port for admitting air therethrough into the volume establishing a two-phase air bubble/fuel dispersion enabling two-phase flow of air bubbles and fuel from the fuel volume through the orifice when the valve lies in the open position.

In a further preferred embodiment according to the present invention, there is provided a fuel injector for an engine comprising a housing defining a volume for receiving fuel upstream of a fuel injection orifice in the injector, a valve movable between positions closing and opening the orifice and an air inlet to the volume including a porous member permeable to air for supplying air to the volume to form air bubbles in the fuel in the volume whereby, in response to movement of the valve into the open position, a two-phase flow of air bubbles and fuel passes through the orifice.

In a still further preferred embodiment according to the present invention, there is provided, in a fuel injector for an engine wherein the fuel injector includes a housing defining a fuel volume, an orifice in the housing and a valve for opening and closing the orifice, a method of operating the fuel injector comprising the steps of providing an air inlet to the fuel volume upstream of the orifice, disposing a porous member in the inlet, flowing air through the porous member into the fuel volume to form an air bubble/fuel dispersion in the fuel volume and flowing the air bubble/fuel dispersion through the orifice when the valve opens the orifice.

Accordingly, it is a primary object of the present invention to provide a novel and improved fuel injector and methods of operating a fuel injector in which a two-phase air bubble/fuel dispersion is ejected through the injector orifice into the engine for improved atomization, fuel economy and burn with consequent decreased emissions.

BEST MODE FOR CARRYING OUT THE INVENTION

Figure 1:
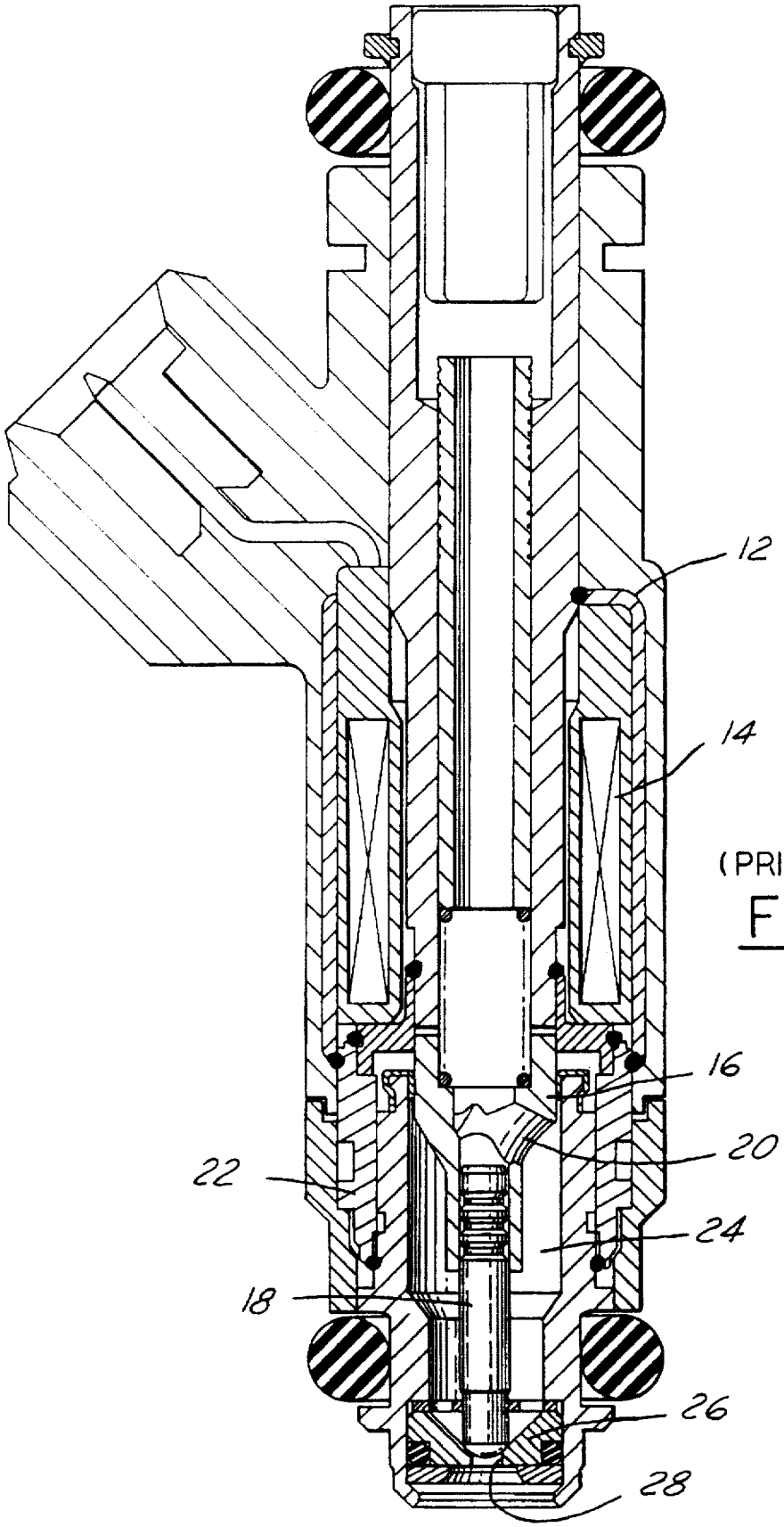
(PRIOR ART) FIG. 1
FIG. 1 is a longitudinal cross-sectional view of a fuel injector according to the prior art.

Referring now to FIG. 1, there is illustrated a prior art fuel injector, generally designated 10, including a housing assembly 12 mounting a coil assembly 14 and an armature 16 coupled to a needle valve 18. Surrounding the needle valve 18 is a housing 22 defining a fuel volume 24 in communication with a fuel flow passage 20 through the armature 16. At the lower end of housing 22 is a valve seat 26 defining an orifice 28 through which fuel is ejected from the fuel ejector into the engine. It will be appreciated that the coil 14 and armature 16 cooperate to open and close orifice 28 by periodic axial movement of needle valve 18 within fuel volume 24.

Figure 2:
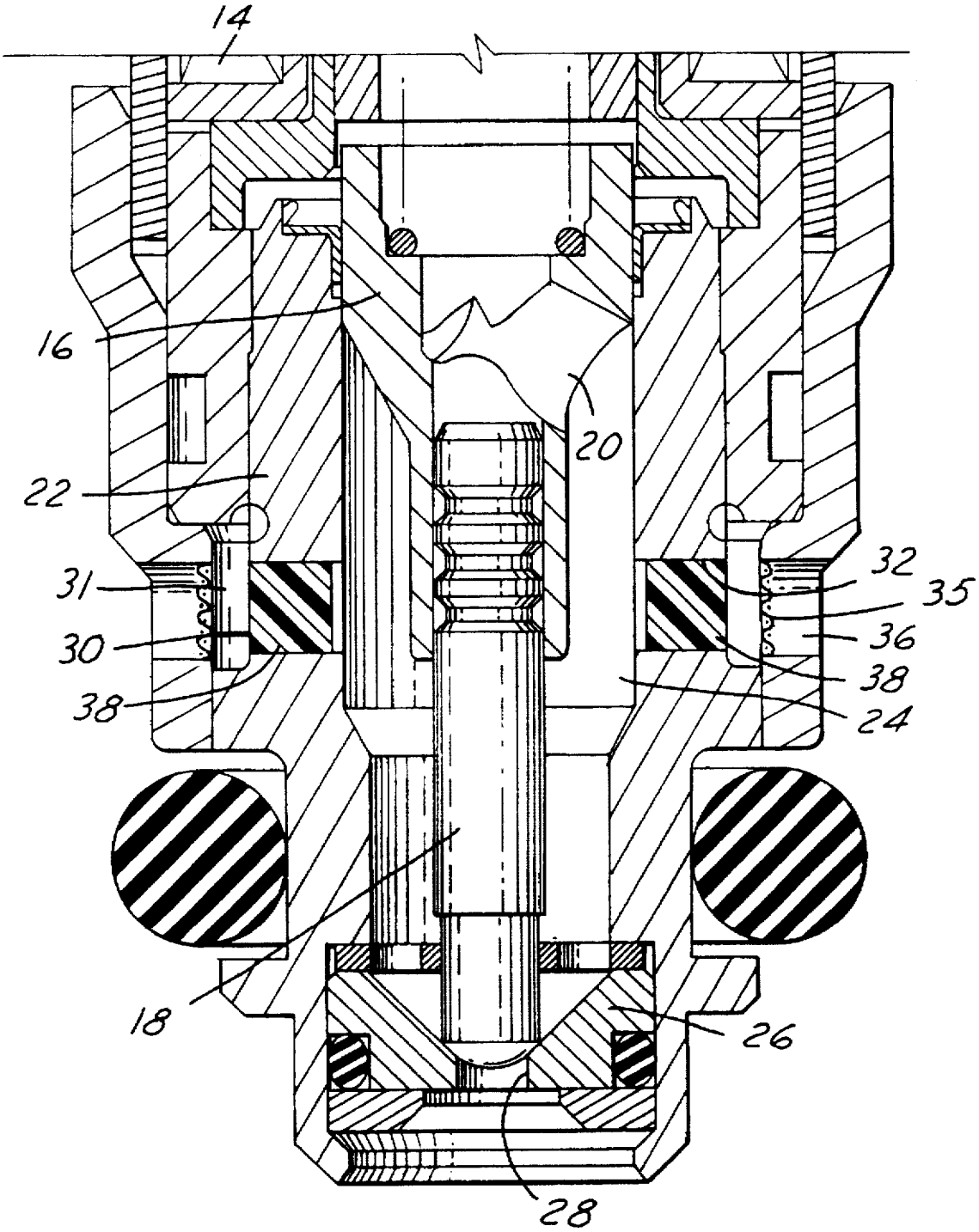
FIG. 2 is an enlarged cross-sectional view of the lower end of an injector constructed in accordance with the present invention.

Referring now to FIG. 2, there is illustrated the lower end of a fuel injector constructed in accordance with the present invention and which injector includes all of the elements of the fuel injector described in FIG. 1. Additionally, however, provision is made for the creation of air bubbles in the fuel within the fuel volume 24 to provide a two-phase air bubble/fuel dispersion in the fuel volume for flow through the injector orifice. To accomplish this, an air inlet 30 is provided through the side walls of the valve housing 22 defining the fuel volume 24. The air inlet may comprise an annular chamber 31 about the injector defining an air manifold in communication with one or more openings 36 to which air supply lines may be coupled and one or more ports 32 in direct communication with the fuel volume 24. Air filters 35 may be provided as necessary or desirable. Each port 32 is provided with a porous member 38 which is permeable to air and impermeable to fuel. Air is provided under pressure from a suitable air pressure source for flow through the porous member 38 into the fuel volume 24. An example of one such air pressure source is disclosed in commonly owned U.S. Pat. No. 5,666,927 (Attorney Docket Nos. 94E7761 and 242-51), issued Sep. 16, 1997, the disclosure of which is incorporated herein by reference. As illustrated, it is desirable to locate the air inlet 30 having the porous member 38 as close to the orifice 28 of the injector 10 as possible given size constraints and the need to seal the injector, for example, in the engine intake.

The pore size of each porous member 38 is such as to provide sufficiently small air bubbles in the fuel in the fuel volume so that the bubbles will not rise in the fuel or will rise only very slowly and at a rate which will not affect or substantially affect the mass flow of the two-phase air bubble/fuel dispersion through the injector orifice 28. It has been found that a pore size of 40 microns or less provides sufficiently small bubbles as to consistently enable a controlled mass of the air bubble/fuel dispersion through the injector orifice upon opening the needle valve. The porous members 38 may be formed of ceramic, metallic or foamed plastic materials or other materials which will provide a desired bubble size and substantially uniform distribution of bubbles into the fuel volume within the injector. To obtain the appropriate mass of bubbles in the fuel injector after selection of the proper pore size, the mass flow of bubbles can be changed by changing the pressure differential across the porous membrane, the area of the porous membrane, or the thickness of the membrane, or any two or more of these parameters, whereby the desired two-phase flow condition downstream of the orifice can be provided. With the appropriate bubble size, i.e., 40 microns or less, effervescence of the gas within the fuel is substantially precluded.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector for an engine comprising:

a housing defining a volume for receiving fuel and having an orifice;

a valve movable between positions closing and opening said orifice;

said housing including a port, a porous member in said port for admitting air therethrough into said volume establishing a two-phase air bubble/fuel dispersion enabling two-phase flow of air bubbles and fuel from said fuel volume through said orifice when said valve lies in said open position.

2. A fuel injector according to claim 1 wherein said porous member is impermeable to fuel.

3. A fuel injector according to claim 1 wherein said porous member has a pore size establishing an air bubble size sufficient to preclude substantial effervescence of the dispersion in the fuel volume.

4. A fuel injector according to claim 1 wherein said porous member has a 40 micron pore size or less.

5. A fuel injector according to claim 1 wherein said porous member is formed of a ceramic material.

6. A fuel injector according to claim 1 wherein said porous member is formed of a metallic material.

7. A fuel injector according to claim 1 wherein said porous member is formed of a foamed plastic material.

8. A fuel injector according to claim 1 wherein said housing includes a plurality of ports with a porous member in each said port for admitting air therethrough into said fuel volume.

9. A fuel injector according to claim 1 wherein said porous member has a 40 micron pore size or less, said porous member being formed of one of ceramic, metallic and foamed plastic materials.

10. A fuel injector for an engine comprising:

a housing defining a volume for receiving fuel upstream of a fuel injection orifice in said injector;

a valve movable between positions closing and opening said orifice; and an air inlet to said volume including a porous member permeable to air for supplying air to said volume to form air bubbles in the fuel in said volume whereby, in response to movement of said valve into said open position, a two-phase flow of air bubbles and fuel passes through said orifice.

11. A fuel injector according to claim 10 wherein said porous member is substantially impermeable to fuel.

12. A fuel injector according to claim 10 wherein said porous member has a pore size establishing an air bubble size sufficient to preclude substantial effervescence of the dispersion in the fuel volume, said porous member having a 40 micron pore size or less, said porous member being formed of one of ceramic, metallic and foamed plastic materials.

13. In a fuel injector for an engine wherein the fuel injector includes a housing defining a fuel volume, an orifice in said housing and a valve for opening and closing said orifice, a method of operating the fuel injector comprising the steps of:

providing an air inlet to said fuel volume upstream of said orifice;

disposing a porous member in said inlet;

flowing air through said porous member into the fuel volume to form an air bubble/fuel dispersion in said fuel volume; and flowing said air bubble/fuel dispersion through said orifice when said valve opens said orifice.

14. A method according to claim 13 including controlling the mass of the bubbles in the air bubble/fuel dispersion by changing one of the pressure difference across the porous membrane, the area of the porous membrane and the thickness of the porous membrane.

15. A method according to claim 14 including providing a bubble size to provide an air bubble/fuel dispersion in which the air bubbles substantially do not rise in the dispersion.

* * * * *